US005570730A

United States Patent [19]

Keehn, Jr. et al.

[11] Patent Number: 5,570,730

[45] Date of Patent: Nov. 5, 1996

[54] SPILL RESISTANT FUEL CAP AND VENTILATION SYSTEM

[75] Inventors: Douglas A. Keehn, Jr., Merritt Island; Frank B. Ousley, II; William W. Powell, both of Cocoa, all of Fla.

[73] Assignee: Ray Industries, Inc., Knoxville, Tenn.

[21] Appl. No.: 410,069

[22] Filed: Mar. 24, 1995

[51] Int. Cl.[6] ..... B63B 17/00

[52] U.S. Cl. ..... 141/59; 141/312; 220/86.2; 220/203.29

[58] Field of Search ..... 141/44–46, 59, 141/302, 307, 312, 325, 326; 137/587, 588; 114/343; 220/203, 29, 86.2

[56] References Cited

U.S. PATENT DOCUMENTS

| | | | |
|---|---|---|---|
| 3,643,690 | 2/1972 | Sarai | 137/587 |
| 3,880,317 | 4/1975 | Arnett | 220/86.2 |
| 4,730,652 | 3/1988 | Bartholomew | 141/302 |
| 4,739,612 | 4/1988 | Stockbridge | 220/86.2 X |
| 4,747,508 | 5/1988 | Sherwood | 141/326 X |
| 5,131,439 | 7/1992 | Bucci | 141/59 |
| 5,205,330 | 4/1993 | Sekine | 141/59 |
| 5,234,122 | 8/1993 | Cherng | 220/86.2 X |
| 5,246,027 | 9/1993 | Morris | 220/203.29 |
| 5,275,213 | 1/1994 | Perkins | 141/59 |
| 5,322,099 | 6/1994 | Langlois | 141/307 |
| 5,462,100 | 10/1995 | Covert et al. | 141/59 |
| 5,507,324 | 4/1996 | Whitley, II et al. | 141/59 |

*Primary Examiner*—J. Casimer Jacyna
*Attorney, Agent, or Firm*—Malin, Haley, DiMaggio & Crosby, P.A.

[57] ABSTRACT

A spill resistant fuel cap and ventilation system to prevent fuel from spilling during the boat refueling process and when internal fuel system pressure increases, and for maintaining the internal pressure of the fuel system at a predetermined level, wherein the system comprises a fuel fill neck fluidly connected to a tank, the fuel fill neck having two venting apertures defined by it with one venting aperture in fluid communication with the tank and the other aperture in fluid communication with an air intake vent, such that the system provides two vapor and air venting paths for removing vapor and air during refueling and for relieving pressure, respectively, and such that an air intake venting path is formed for inducing air into the system through the fuel fill neck to prevent pulling vacuum in the tank during boat engine operation.

12 Claims, 3 Drawing Sheets

SPILL RESISTANT FUEL CAP AND VENTILATION SYSTEM

BACKGROUND OF THE INVENTION

1. Field of the Invention

This invention relates generally to a fuel system that prevents fuel from spilling during boat fueling, and more particularly, to a spill resistant fuel cap ventilation system that provides at least two different venting paths without allowing any passages for fuel to spill. One path is for fuel vapor to vent during refueling while the second path provides an air intake vent for drawing air into the fuel system during operation.

2. Description of the Background Art

During the fueling of boats, fuel is known to spill from the fuel fill, air intake vent and/or tank vent. As a result, fuel ends up spilling into the surrounding water or seeping into the ground in the area of the spill. Allowing fuel to escape from fuel systems in this manner obviously raises serious environmental concerns.

The conventional fuel fill may be described as a neck which provides an opening at the top end for inserting a fuel nozzle and an opening at the lower end for attaching the fuel line leading to the fuel tank. The background art fuel system known, as shown in FIG. 1, includes the fuel fill 1, a tank 2, a cap 3, and a tank vent aperture 4 for receiving air into the tank 2 from an air intake vent 5 via a connecting vent line 6. The air intake vent 5 draws air into the fuel system during operation for obtaining the correct air to fuel mixture in the tank as fuel is pulled from the tank through the engine feed line 7. As presently designed, both the fuel fill neck 1 and the venting apertures 4 and 5 allow fuel to escape from conventional boat fuel system. Fuel usually spills over the fuel fill 1 when fuel overflows the neck 1 since there is nothing to provide a sealed fit with the nozzle for blocking overflow. Fuel also escapes through the air intake vent. Fuel enters the vent line 6 through the tank vent aperture 4 and eventually escapes from the air intake vent 5.

Present fuel systems spill fuel during fueling because they lack structure for sealingly engaging the nozzle with the fuel fill 1 and for preventing fuel from exiting the air intake vent 5. A gap usually exist around the nozzle when it is inserted into the fuel fill neck. Fuel is able to escape through the gap between the nozzle and inner diameter of the neck when the neck overflows with fuel. Conventional fuel systems do not attempt to obstruct the gap around the nozzle with rings or washers because the space is needed to let air escape from the tank and neck when fueling. That is, when a tank is being filled, the fuel displaces air in the tank and the air displaced must be provided a path for venting. The gap around the nozzle affords the requisite passage for air to vent.

Fuel also exits through the air intake vent 5. Fuel passes through the tank vent aperture 4 and into the air vent line 6 during fueling. This fuel has a tendency to escape from the air intake vent 5 when fueling or when the fuel trapped in the vent line 6 is forced into the air intake vent 5 by internal pressure. However, the air intake vent 5 cannot be removed since it is necessary for safely operating the fuel system. The air intake vent 5 allows air into the fuel system to replace fuel used by the engine. The fuel drawn from the fuel tank 2 during operation must be replaced by air to prevent pulling a vacuum in the tank 2. When the system is operating, the fuel cap 3 provides a tight seal at the fuel fill as the engine pulls fuel from the tank. In an unvented fuel system, a vacuum would be created inside the tank 2 as fuel was removed, eventually causing the tank to internally collapse. Therefore, the air intake vent 5 is incorporated to supply air into the tank to replace the fuel that is removed so that a vacuum is not created. The air required enters the fuel system through the air intake vent 5, passes through the fuel tank vent system and into the tank 2. This air venting path allows the boat engine to run efficiently and to consume fuel without pulling vacuum in the fuel tank. This is the only path known where air can enter the fuel system, since air must actually be induced into the fuel system.

Fuel spills are also known to occur when the temperatures inside the fuel system increase. As gas or fuel in the system gets hot it expands which increases the internal pressure in the fuel system. This increase in pressure forces fuel in the air vent lines 6 to escape out the air intake vent 5. The temperatures inside the fuel tank usually rise because of ambient heat, exposure to the sun, or storage in hot, enclosed areas. These heated conditions cause the gas in the fuel system to expand and pressurize the system. Since ambient temperatures can not be controlled, fuel inevitably percolates out the air intake vent.

There is nothing presently known in the background art which prevents fuel spills when fueling boats or that prevents fuel from escaping through the air intake vent. Therefore, there exists a need for a spill resistant fuel cap and ventilation system to prevent fuel spills through the air intake vent and from the fuel fill neck especially during fueling and under heated conditions.

SUMMARY OF THE INVENTION

It is an object of the present invention to provide a spill resistant fuel cap ventilation system that limits the spilling of fuel during fueling of boats.

It is another object of the instant invention to prevent fuel from spilling over the fuel fill during fueling and from exiting through the air intake vent.

It is a further object of the instant invention to provide a spill resistant fuel cap ventilation system that prevents fuel from leaking through the air intake vent due to fuel over flow in the fuel fill and increased pressure in the fuel system.

It is an additional object of the instant invention to provide a spill resistant fuel cap and ventilation system that relieves pressure in the fuel system.

These and other objects are accomplished by the present invention which comprises a spill resistant fuel cap and ventilation system for use in boats to prevent fuel spills and to equalize the internal pressure in the boat's fuel system so as to maintain the internal pressure at a predetermined level. The instant invention represents an improvement over conventional boat fueling systems, wherein it accomplishes its objectives by providing two different paths for air or vapor to vent from the system during fueling and operation, and it introduces a one-way air intake venting path for inducing air into a boat's fuel tank during boat engine operation without letting fuel escape at other times.

Unlike background fueling systems, the instant invention includes a dual vented fuel fill neck in fluid communication with the fuel tank for filling the tank with fuel and which employs two different venting lines or hoses for directly connecting to the fuel fill neck. One venting line fluidly joins the fuel fill neck and the fuel tank, while the second venting line fluidly joins the fuel fill neck and the boat's air intake vent. The terminology "fluidly joining" does not necessarily imply only passing fluid, rather it provides for the venting and passage of vapor and/or air. The fuel fill tank vent, defined by the fuel fill neck, and the tank vent line joining the fuel fill and fuel tank provides a two-direction path for air to enter the fuel tank during a boat engine's operation to replace air pulled from the tank, and for allowing air to be vented out of the tank via the fuel fill neck when the tank is being filled with fuel. The air intake vent line joining the fuel fill neck and the air intake vent incorporates an internally installed one-way valve inside the air vent line situated therein to only allow air to pass into the fuel system without allowing fuel to escape from the system through the air intake vent via the air vent line.

During refueling, all of the tank vapor or air must exit the fuel tank via the tank vent line and fuel fill neck. A vented splash ring inside the fuel fill neck snugly receives a fueling nozzle to prevent fuel from spilling or splashing out of the fuel fill neck. At the same time, the splash ring allows displaced air or vapor from the tank to escape through venting orifices defined around the perimeter of the splash ring. In addition, fuel is precluded from escaping through the air intake vent because of the one-way valve disposed in the air venting line. Moreover, the fuel fill neck is at the highest point in the fuel system, which also discourages fuel from escaping. Thus, during refueling, the nozzle fits tightly into the fuel fill neck in a receiving aperture defined by the splash ring and the displaced vapor or air from the tank is permitted to vent around the perimeter of the nozzle.

The instant invention also incorporates a fuel cap which forms a vapor tight seal when screwed to the fuel fill neck to help reduce fuel leaks. The instant invention incorporates a pressure relieving mechanism in the fuel cap to maintain the internal pressure of the fuel system at a predetermined level. As discussed in the background art, increases in the internal pressure caused by fuel expansion can cause fuel in the system to percolate and leak from the system through paths such as the air intake vent. The instant invention prevents fuel leaking by incorporating the one-way valve in the path of the air intake vent and by incorporating the pressure relieving mechanism in the fuel cap. Thus, a constant internal pressure is maintained despite fuel or gas expansion, thereby preventing fuel leaks. In addition, the instant invention allows air to be introduced into the fuel tank as fuel is pulled from the tank without allowing fuel to leak. This is accomplished by the separate air intake venting circuit, as discussed above. This air intake vent circuit is defined by air vent line joining the air intake vent and fuel fill, the one-way valve, or check valve, installed in the air vent line, the fuel fill neck and the tank vent line joining the fuel fill neck and tank.

In accordance with these and other objects which will become apparent hereinafter, the instant invention will now be described with particular reference to the accompanying drawings.

DESCRIPTION OF THE PREFERRED EMBODIMENTS

Figures 3, 5, 5A, 5B:
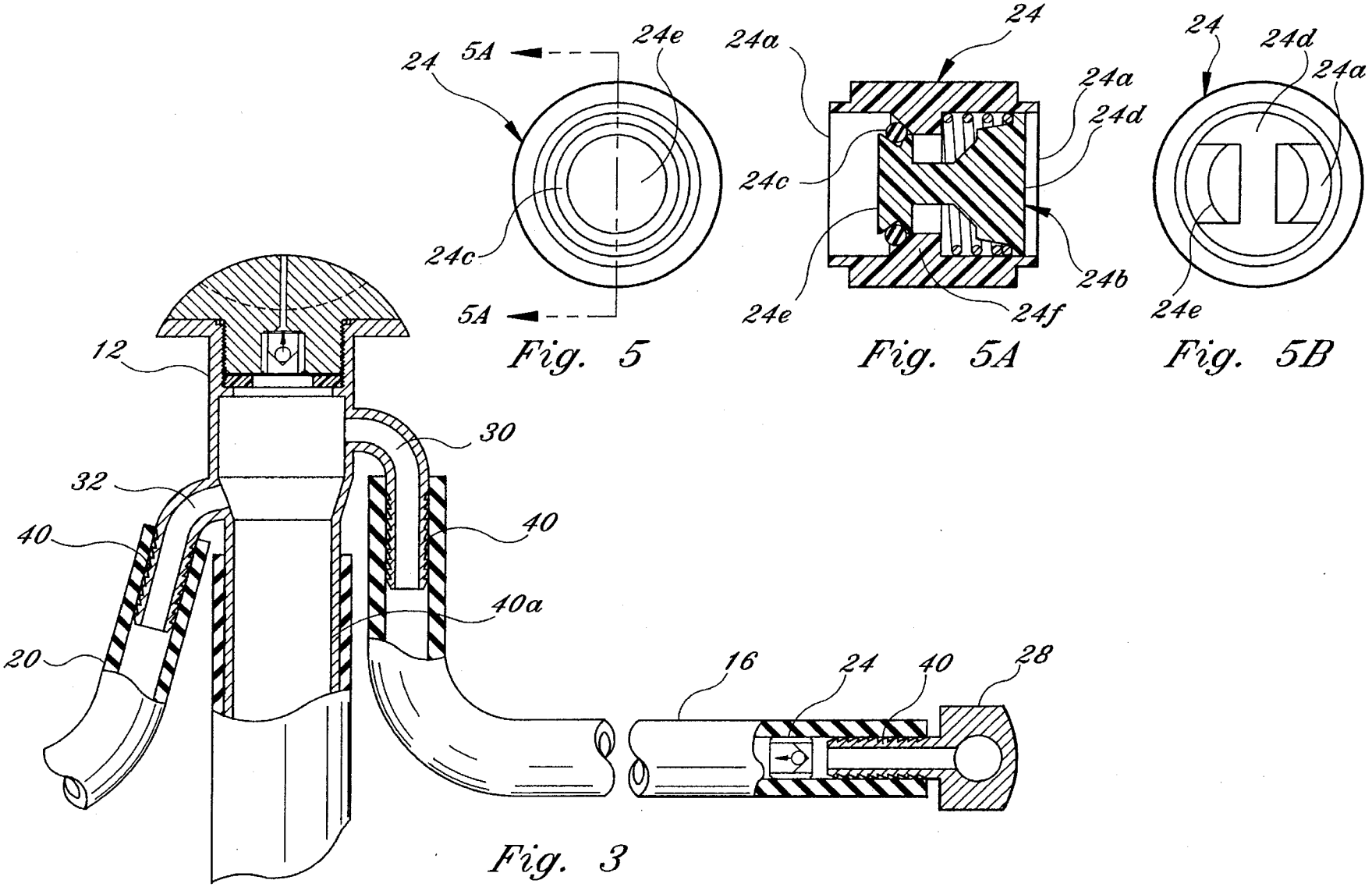
FIG. 3 a partial elevational view of the preferred embodiment of the instant invention illustrating an enlarged view of the fuel fill, dual venting paths and spill protection features of the instant invention.
FIG. 5 is a bottom elevational view of the check valve employed in the instant invention looking into the entry side of the valve.
FIG. 5A is a cross-sectional view of the check valve of the instant invention taken along lines 5A—5A of FIG. 5.
FIG. 5B is a top elevation view of the check valve.
Figure 4:
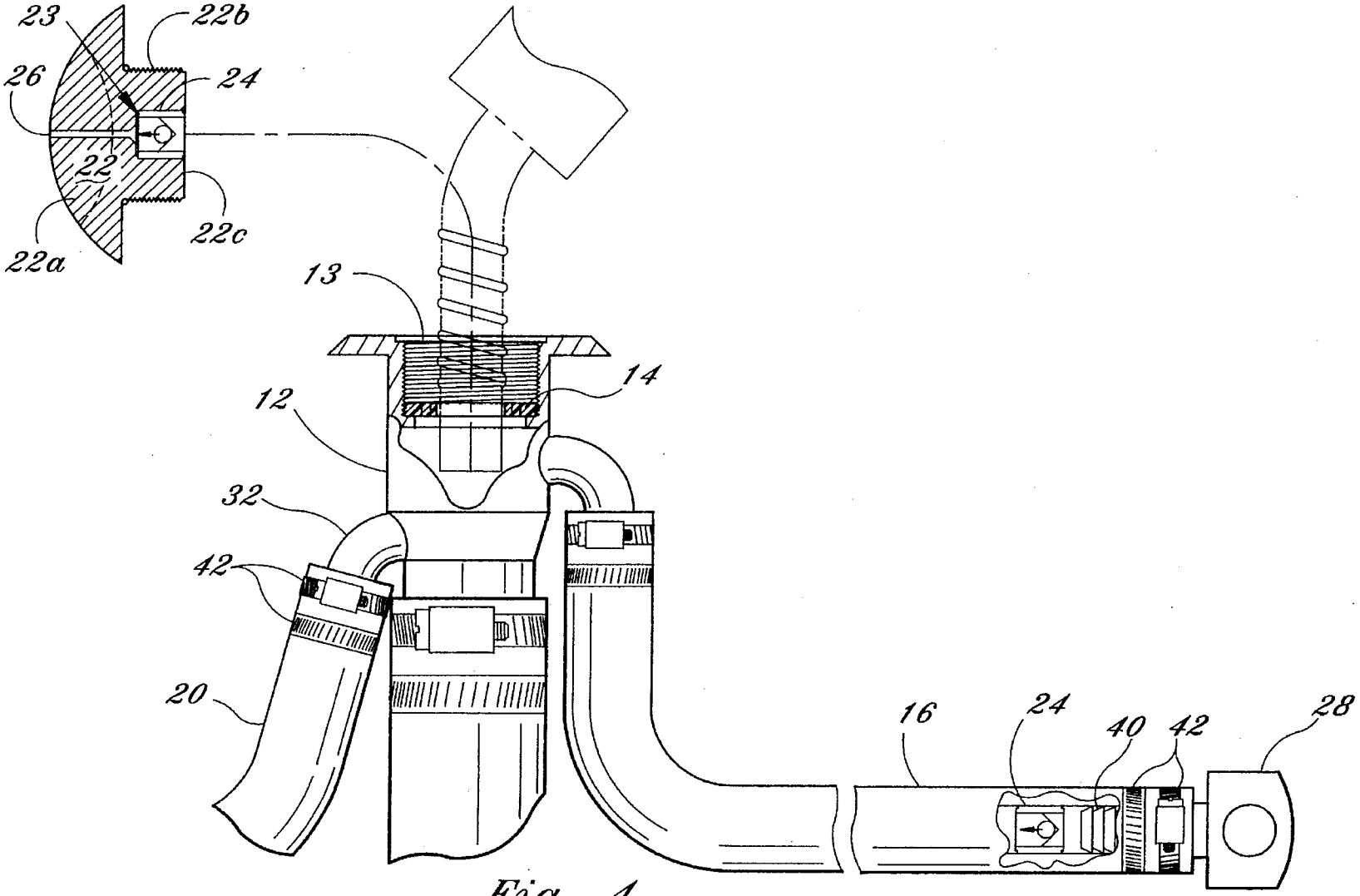
FIG. 4 is a partial exploded elevational view of the preferred embodiment of the instant invention illustrating the cap removed from the fuel fill.

With reference to the drawings, FIGS. 1–6A depict a spill resistant fuel ventilation system generally indicated by the reference numeral 10 and preferably comprising a fuel fill 12, a vented splash ring 14, an air intake vent line 16, a first check valve 24, a tank vent line 20 and a fuel cap 22 having a pressure relief valve 23. The present invention may also include an air intake vent 28 in fluid communication with the air intake vent line 16 for inducing air into the fuel system tank 11. The instant invention prevents fuel spills and leaks by controlling the flow of air into and out of the fuel system 10 and equalizing or maintaining the internal pressure at a relatively constant level. The objects of the present invention are accomplished by running the air intake vent line 16 and tank vent line 20 up to the fuel fill 12, incorporating a pressure relief valve or structure 23 in the fuel cap 22, providing a vented splash ring 14 in the fuel fill 12 and installing a first check valve 24 in the air intake vent line 16. The first check valve 24 is oriented to only allow air to pass into the system from the air intake vent 28. The pressure relief valve 23 may comprise a second check valve 24 pressed into the lower end of the fuel cap 22 and a fuel cap venting path 26 defined by fuel cap 22 in alignment with and above the second check valve 24. Unlike the first check valve 24, the second check valve 24 is oriented for only allowing air or vapor to escape the fuel system. The second check valve 24 is typically disposed at the relative highest point in the fuel system and is designed to only release air or vapor at high pressures and not fuel. Both the first and second check valves 24 are shown in FIGS. 3 and 4 as a symbolic representation of the actual check valve employed in the instant invention. The preferred first and second check valves 24 installed in the air vent line 16 and the fuel cap 22, respectively, are shown in structural detail in FIGS. 5 and 5A. It should be noted that more conventional check valves may be used without departing from the scope and spirit of the instant invention.

Figure 1:
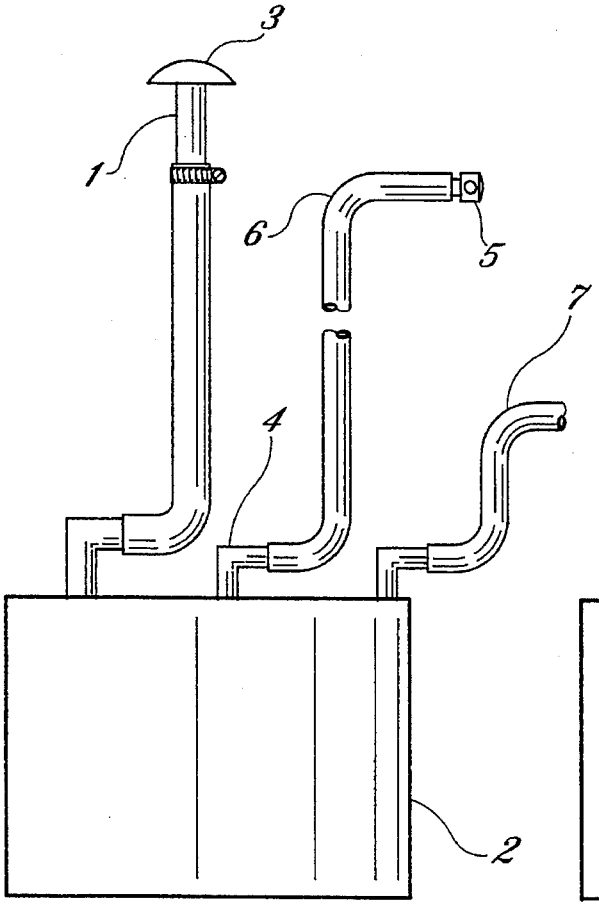
Fig. 1 PRIOR ART
FIG. 1 is an elevational view of a conventional background embodiment of a boat fueling system.
Figure 2:
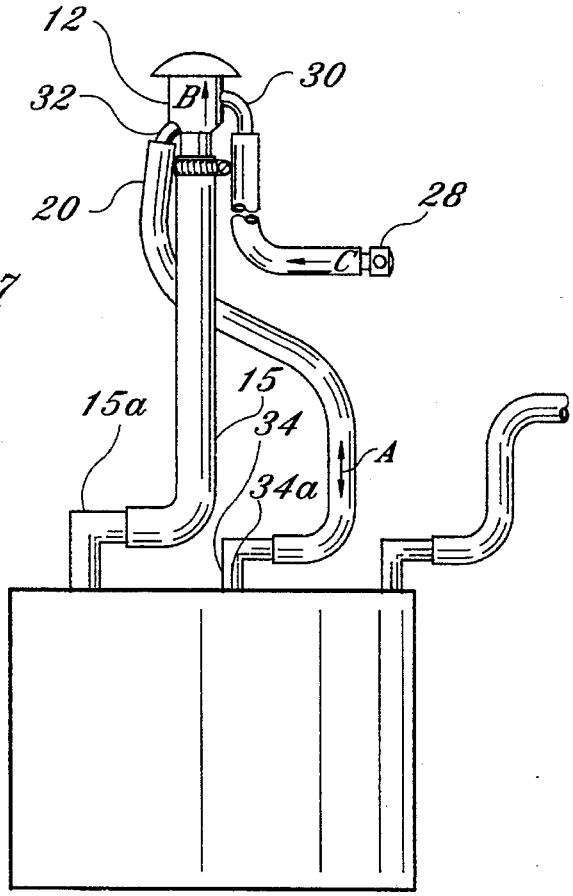
FIG. 2 is an elevational view of the preferred embodiment of the spill resistant fuel ventilation system of the instant invention.
Figure 6:
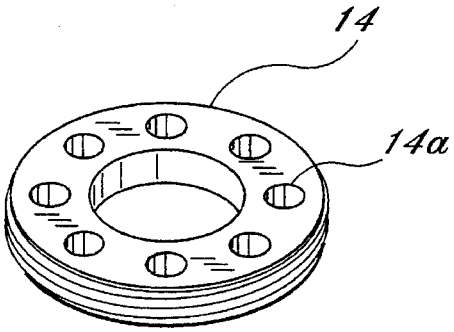
FIG. 6 is a perspective view of the splash ring of the instant invention.
Figure 6A:
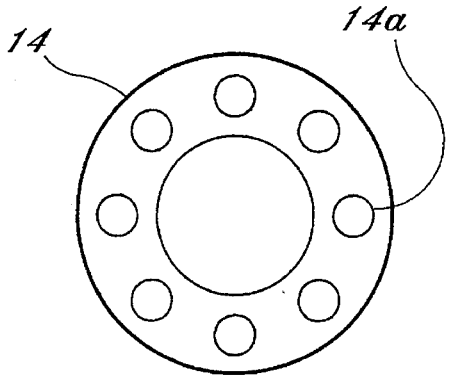
FIG. 6A is a top elevation view of the splash ring of the instant invention.

The resulting fuel system of the instant invention provides a spill resistant fuel cap and ventilation system 10 that prevents fuel spills or leaks during fueling or running the boat engine while allowing air or vapor to exit from the fuel system through two paths, A and B, as seen in FIG. 2. In addition, the preferred embodiment of the fuel system 10, limits the intake of air into the tank 11 through one path, C, to replace fuel pulled from the tank 11 with air. The fuel cap 22 forms a vapor tight seal when screwed to the upper open end 13 of the fuel fill 12. Thus, during operation, the only path, i.e B, for air or vapor pressure to be released is through the pressure relief valve 23 and the only path, i.e. C, for air to enter the fuel system 10 is through the air intake vent 28 via the air vent line 16. It should be noted that the pressure relief valve 23 as defined by the cap 22 releases internal fuel system pressure anytime pressure in the system exceeds a predetermined threshold dictated by the pressure relieving dynamics of the pressure relief valve 23. The first venting path A vents air or vapor during fueling without allowing fuel to escape.

With reference to FIG. 2, the instant invention provides two different paths, A and B, for vapor or air to vent, both of which communicate directly with the fuel fill 12. During refueling, all the tank vapor or air exits the fuel fill 12 through the first vent path A. The first vent path, A, is defined by the splash ring venting orifices 14a and the tank vent line 20 which fluidly connects the tank 11 and the fuel fill 12. The splash ring 14 preferably threadably engages the interior diameter of the fuel fill 12 and is situated above the fuel fill tank vent 32 as seen in FIGS. 3 and 4. The fuel fill tank vent 32 is joined to the tank vent 34 by the tank vent line 20. The first vent path A allows vapor to be removed from the tank 11 as fuel displaces it. When fueling the tank 11, air or vapor present in the tank 11 passes through the tank vent 34 via tank venting aperture 34*a* and into the tank vent line 20. The vented vapor enters the fuel fill 12 through the fuel fill tank vent 32 and is released through vapor venting orifices 14a defined by the splash ring 14. It is important to note that the splash ring 14 defines a fuel nozzle.

The second venting path B is defined by the pressure relief valve 23 in the fuel cap 22. The pressure relief valve 23 relieves pressure in the fuel system through the second venting path B to reduce internal pressure caused when the gas or fuel expands. The pressure relief valve 23 comprises the second check valve 24 and fuel cap venting aperture 26 whereby the second check valve 24 is pressed into the fuel cap 22 in fluid alignment with the fuel cap venting path 26. When pressure in the system exceeds a predetermined level, the second check valve 24 pops or actuates from its seated position to let vapor or air escape through the top of the fuel cap 22.

The third venting path C is defined by the air intake vent 28, the fuel fill air vent 30, the air intake vent line 16 fluidly joining the air intake vent 28 and the fuel fill air vent 30, the fuel fill tank vent 32 and the tank vent line 36. The fuel fill air vent 30 is preferably defined by the fuel fill 12 below the splash ring 14 and above the fuel fill tank vent 32. The air intake vent 28 draws air into the fuel system and feeds it through path B to supply air into the tank 11 when fuel is being drawn therefrom during operation. The actual path defining the third venting path C comprises air traveling from the air intake vent 28 through the air intake vent line 16 into the fuel fill 12 via the fuel fill air vent 30, passing out the fuel fill tank vent 32 and through the tank vent line 20 into the tank 11. The tank 11 defines a tank vent 34 and tank vent aperture 34*a* as shown in FIG. 2. Accordingly, the tank vent 34, tank vent line 20 and fuel fill tank vent 32 provide a dual direction path for venting vapor or air from the tank during fueling or when relieving internal pressure from the fuel system via the pressure relief valve 23, and for venting air into the tank 11 when the engine is running.

The fuel fill 12 comprises a neck-like structure defining a passageway in communication with a fuel fill hose or fluid feed line 15 for filling a fuel tank with fuel. The fuel fill 12 provides a hose mounting adapter or pipe fitting 40*a* at its lower end for connecting the fuel feed line 15, wherein the other end of the fuel feed line 15 attaches to the fuel feed port on the tank 11. The fuel fill 12 comprises a first vent or air vent 30 and a second or tank vent 32 protruding from the neck 12 for mounting the air vent line 16 and the tank vent line 20, respectively. The fuel fill air vent 30 defines a first vent aperture and the fuel fill tank vent 32 defines a second vent aperture, both of which provide passage. The second vent aperture is typically below the first air vent aperture. Both the neck air vent 30 and tank vent 32 comprise hose mating adapters or pipe fittings 40 protruding from the outside of the fuel fill neck 12 for connecting the lines 16 and 20. Fuel fill air vent 30 and tank vent 32 are typically integrally formed with the fuel fill neck 12 to eliminate any potential leaks, however, they may comprise hardware which is sealingly affixed to the fuel fill neck 12. The fuel fill neck 12 also defines a threaded interior diameter for threadably engaging the fuel cap 22. Fuel cap 22 has a threaded outer diameter equal to the inner diameter of the fuel fill neck 12 for threadably engaging the fuel fill neck 12. The fuel fill neck 12 defines a lip or ledge around its upper edge for engaging the head portion 22*a* of the fuel cap 22. Excess pressure which develops inside the fuel fill neck 12 or passageway 12*a* is able to escape through the pressure relief valve 23 defined by the fuel cap 22.

Referring to FIG. 2, the fuel fill 12 may connect directly to the tank 11 or it may be connected to a fuel feed line 15 which directly attaches to the tank 11 at the tank's fuel feed port 15*a*. If the fuel fill 12 is directly connected to the tank, it comprises a longer defined neck for reaching from the tank 11 to the deck of the boat. The fuel fill 12 preferably includes standard fittings of 1.5 inches diameter, but the fuel fill and fittings may vary in size without departing from the scope and spirit of the instant invention. In fact, each of the lines 15, 16, and 20 adaptably mates to the pipe style fittings 40 defined at the corresponding attachment points and may use conventional hardware such as clamps. The lines 15, 16, and 20 preferably tightly mate over the pipe fittings 40 and are additionally secured to the pipe fittings by hose clamps 42. The fittings 40 may be ribbed, as shown, or smooth, rigid projections like the fitting 40*a* shown at the lower end of the fuel fill neck. The fuel fill 12 is a neck which provides a path for fuel to feed into the tank 11. The fuel fill 12 defines an upper open end 13 for receiving a fuel nozzle and an open bottom end having a fitting for attaching the fuel feed line 15. The fuel fill also defines first and second venting apertures 30 and 32 which communicate with the air intake vent 28 and tank 11, respectively.

The air vent line 16 fluidly connecting the fuel fill air intake vent 30, i.e. first venting aperture, and air intake vent 28 typically comprises a conventional hose line rated for extreme heat such as that caused by fire and engines. The fuel system of the instant invention includes lines 15, 16, and 20 which may be rated under conventional heat requirements. The lines 15, 16, and 20 incorporated typically undergo two minute burn test. The first check valve 24 is preferably installed inside the air vent line 16 and is protected from extreme heat by the line. This allows it to be manufactured by a plastic or thermoplastic-like material not necessarily meeting the same heat standards of the actual line 16. The check valve 24, however, could be installed directly to the air intake vent 28, but it would also have to satisfy the heat requirements tested by the burn test. The burn test is required because the air intake vent and other elements of the invention are typically manufactured from a metallurgical material such as aluminum, which transmits heat generated by the system.

The fuel cap 22 not only forms a vapor tight seal at the fuel fill neck upper end 13 but acts as a pressure relief source by including the pressure relief valve 23 as noted above. The pressure relief mechanism 23 relieves and stabilizes pressure built up in the fuel system which increases when the fuel in the system expands under increased heat conditions. The pressure relief mechanism 23 includes the second check valve 24 and a fluidly aligned cap venting aperture 26 defined by the cap 22. The second check valve 24 is securely pressed into the fuel cap neck 22*b* at the cap lower end 22*c* contiguous with a cap venting aperture 26. This provides a direct vapor path from the cap bottom 22*c* to the surface of the fluid cap head 22*a*. Thus, a continuous passageway is provided from the second check valve passageway 24*a* out the head 22*a* of the fuel cap 22. The cap neck 22*b* is threaded along its exterior surface so as to threadably match the threads in the interior diameter of the fuel fill 12. When the cap 22 is screwed tightly into the fuel fill 12, it contiguously rests against the splash ring 14 to provide a vapor tight seal.

With reference to FIGS. 5 and 5A, the first and second check valves 24 incorporated into the air vent line 16 and fuel cap 22, respectively, each comprise a spring loaded poppet 24*b* mounted in the check valve passageway 24*a* which is defined by the interior wall of the valve body. A flange 24*f*, integrally formed with the interior wall of the valve housing 24*g*, partially intersects the passageway 24*a* proximal a central point in the valve 24 so as to create a concentric sleeve inside the valve through which the poppet 24*b* slidably oscillates. The flange 24*f* may form a tapered seat on one side, as shown, for receiving the poppet head that is actually received by the flange 24*f* for blocking the passageway 24*a* to prevent flow in both directions through the valve. Both ends of the poppet 24*b* define heads 24*d*, 24*e* which are disposed on opposite sides of the flange 24*f* to prevent the poppet 24*b* from completely passing through the sleeve. The seated poppet head 24*e* meets and sits in the sleeve defined by the flange 24*f* when pressure from air or fluid enters that side of the valve. The seated poppet may also be tapered towards the actual poppet shaft for sealingly engaging the tapered side of the flange 24*f*. A semi-resilient O-ring 24*c* surrounds the portion of the poppet adjacently below the seated poppet head 24*e* for sealingly engaging the flange sleeve. A spring 24*h* wraps around the poppet on one side of the flange 24*f* proximal a leading head 24*d*. The leading head 24*d* actually receives the pressure from the vapor or air as it enters the passageway 24*a* and causes the seated poppet head 24*e* to unseat when the pressure overcomes the force of the spring. The spring 24*h* may be fixed at one end to the valve body and at the other end to the poppet 24*b* or it may float freely around the poppet. The pressure at which the poppets 24*b* actuate is directly dependent on the spring force K of the poppet spring 24*h*. For instance, the check or poppet 24*b* in the first check valve 24 is designed and rated to actuate or pop with an applied air pressure force of approximately a few hundredths of one psi (pounds per square inch). On the other hand, the second check valve 24 has a spring 24*h* and poppet 24*b* designed to pop at a much higher psi.

The first check valve 24 has an outer diameter equal to the inner diameter of the vent line 16 in which it is installed. Accordingly, the first check valve 24 fits flush inside the air vent line 16 so that no leaks are present between the valve 24 and hose interior wall for fuel to seep past. The first valve 24 is also tightly secured in the hose so that it does not move under pressure. More than one check valve 28 may be disposed in the air intake vent line 16 to prevent fuel from exiting the air intake vent 28 while allowing air to enter the system through the vent as fuel is consumed from the fuel tank. The second check valve 24, as noted above, is pressed into the fuel cap neck 22*b*. When the second check valve poppet 24*b* is actuated, the second valve 24 and fuel cap passageway 26 provide a direct path for vapor and air to vent for relieving pressure.

The present invention incorporates at least one one-way action valve, i.e. check valve 24, in the air vent hose 16 connecting the air intake vent 28 and the fuel fill neck 12. More than one check valve 24 may be employed to balance the air intake, but typically, only one check valve 24 of sufficient size and pressure rating is required. The check valve 24 includes the interior spring-loaded poppet 24*b* to close off the passage 24*a* when fuel attempts to escape, but it allows the passage of air into the system in the opposite direction if enough air pressure is present to overcome the poppet loading factor. The check valve 24, therefore, allows air to pass from the outside through the air intake vent 28, the air vent line 16, the first check valve 24, and through the fuel fill 12 and tank vent 34 while preventing any fuel from exiting the air intake vent 28.

The first check valve 24 is installed inside the air vent line or hose 16 instead of to the bayonet, barb, pipe fitting, or adapter to which the hose mounts. The mating adapter or pipe fitting 40 that the hose mounts to usually gets extremely hot during engine operation. The check valves 24 are preferably made from a plastic or polyresin material because plastic valves are lighter, easier to manufacture, and more cost effective. Therefore, to be thermally protected, the first check valve 24 is installed inside the air vent hose 16. Both the first and second check valves 24 may be manufactured from other substances such as metals or alloys which are more resistant to heat for mounting directly to the fittings 40 without departing from the scope of the instant invention. That is, the important feature of this portion of the invention is the presence of the check valve 24 in the passageway defined by the air vent line 16 to allow the flow of air into and through the air vent line 16 while preventing the escape of fuel through the air intake vent 28.

The splash ring 14 comprises a semi-rigid barrier which is securely installed in the fuel fill neck 12 and which defines a nozzle receiving aperture 14a for tightly engaging a conventional fuel nozzle. The splash ring 14 prevents fuel from splashing or spilling out from the neck 12 during fueling. The splash ring 14 has threaded peripheral edges for threadably engaging the fuel fill neck 12 which has corresponding threads in its inner diameter. In the alternative, the splash ring 14 may be sized to achieve an interlocking frictional fit. The splash ring 14 could overcome an interlocking lip inside the neck 12 in another embodiment for a snapping feature. Once a tank is full with fuel the fuel fill neck 12 typically fills very quickly. In conventional boat fuel systems some fuel always spills from the fuel fill 12 because the nozzle doesn't trip off in time or until the fuel fill neck 12 is almost full. The splash ring 14 prevents fuel spills when overflow or splashing occurs, whereby it defines a nozzle receiving aperture for sealingly or tightly engaging a fuel nozzle used when filling the fuel tank with fuel. The splash ring 14 has an outer diameter substantially equal to the inner diameter of the fuel fill 12 and preferably threadably engages the fuel fill 12 so as to be tightly secured therein. The splash ring 14 provides an aperture for sealingly engaging a fuel nozzle when filling the fuel tank with fuel.

The air vent line 16 fluidly communicates the air intake vent 28 with the fuel fill neck 12, via the fuel fill air vent 30, which protrudes from the outside of the fuel fill neck 12 for attaching the air intake vent hose 16. A second venting aperture, i.e. the fuel fill tank vent 32,is defined by the fuel fill neck 12, normally in a position below the first fuel fill vent 30 to allow what is usually cooler air to pass from the air intake vent 28 to the tank 11 by way of the fuel fill 12. This air intake 28 replaces the fuel in the tank 11 as it is consumed by the engine so that a vacuum is not pulled. A fuel tank venting hose 20 connects the second fuel fill vent 32 to the fuel tank 11 to allow the air or vapor to pass between the fuel fill 12 and the fuel tank 11 as previously discussed.

To fill the tank with fuel, the fuel cap 22 is removed from the fuel fill 12 and the fuel nozzle from the fuel pump is inserted through the fuel fill passage 12a defined by the splash ring 14 and fuel fill neck 12. The fuel nozzle usually contains an exterior spring concentric with the nozzle to limit the penetration into the fuel fill passage 12*a*.

The fuel fill 12 also includes an additional fuel tripping assembly at the lower end of the fill to assist the automatic fuel tripping feature found in typical fueling nozzle assemblies. The fuel tripping assembly includes an orifice defined by the lower end of the fuel fill and an internal tube leading up to a diaphragm valve in the fill. When the diaphragm gets covered with fuel the tube fills and the orifice gets covered as well. This causes a fuel vapor build up in the fuel fill 12, causing the nozzle's automatic shut-off to trip. The fuel fill 12 of the present invention defines an adequate volume so that the fuel fill does not completely fill up when fuel rises into the proximity of the orifice to trip the fuel off. In the event that the fuel trip is slow in response or splashing occurs, the splash ring prevents fuel from splashing out of the fuel fill.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A spill resistant fuel and ventilation system for use with a fuel tank in boat fueling systems to minimize fuel spills and leaks during fueling and boat engine operation, said system comprising:

a fuel tank interface means for preventing fuel spills during fueling;

a pressure equalizing means for relieving internal pressure in said system, said pressure equalizing means being releasably attachable to said fuel tank interface means;

a first hose fluidly joining the fuel tank and said fuel tank interface means for venting air and vapor displaced from the fuel tank when filling the fuel tank with fuel;

a second hose, in fluid communication with said fuel tank interface means, for inducing air into the fuel tank as fuel is pulled from the fuel tank during boat engine operation,; and a one-direction valve means, in fluid communication with said second hose, for only allowing air flow into said system through said second hose.

2. A system as recited in claim 1, wherein said fuel tank interface means comprises:

a vented nozzle receiving means for tightly receiving a fuel nozzle used in filling the fuel tank with fuel;

a threaded cylinder neck fluidly joined to the fuel tank, said vented nozzle receiving means being securely disposed in said threaded cylinder neck; and a fuel cap means for forming a vapor tight seal with said threaded cylinder neck, said pressure equalizing means being disposed in said fuel cap means.

3. A system as recited in claim 2, wherein said one-direction valve means comprises a check valve having a spring-loaded poppet disposed in a valve body, wherein said poppet is forced to actuate when pressure sufficient to overcome said spring is applied to said poppet, said spring-loaded poppet returning to a relaxed position or maintaining a relaxed position when the required pressure is below a predetermined threshold.

4. A system as recited in claim 2, wherein said vented nozzle receiving means comprises a splash ring removably secured in said threaded cylinder neck, said splash ring defining at least one venting orifice so as to provide a first air and vapor path for venting air and vapor from said system during fueling, said splash ring defining threaded peripheral edges threadably mating with said threaded cylinder neck.

5. A system as recited in claim 2, wherein said vented nozzle receiving means comprises:

a splash ring removably secured in said cylinder neck, said splash ring for preventing fuel from splashing or spilling out of said cylinder neck;

an interlocking means defined by said splash ring for securely interlocking said splash ring and said cylinder neck;

means for venting air and vapor from said system through said splash ring during fueling, said vapor venting means defined by said splash ring; and nozzle receiving aperture defined by said splash ring for tightly receiving the fuel fuel nozzle used in filling a tank with fuel.

6. A spill resistant fuel and ventilation system for use with a fuel tank in boat fueling systems to minimize fuel spills and leaks during fueling and boat engine operation, said system comprising:

a fuel tank interface means for preventing fuel spills during fueling and for providing a fuel feed path to the fuel tank;

a fuel cap means for forming a vapor tight seal with said fuel tank interface means, said fuel cap means being removably secured to said fuel tank interface means;

a pressure equalizing means for relieving internal pressure in said system, said pressure equalizing means being securely installed in said fuel cap means;

air intake vent means for inducing air into the fuel tank as fuel is pulled from the boat fuel tank during boat engine operation, said air intake vent means being in fluid communication with said fuel tank interface means and an air intake vent;

one-direction valve means, installed in said air intake means, for limiting air flow to one direction so as to only allow air flow into said system; and tank vent means, in fluid communication with said fuel tank interface means, for venting air and vapor displaced by fuel in the fuel tank when filling the fuel tank with fuel.

7. A system as recited in claim 6, wherein said air intake vent means comprises:

a hose fluidly joining said fuel tank interface means and the air intake vent, said one-direction valve means being securely installed in said hose.

8. A system as recited in claim 7, wherein said tank vent means comprises a tank vent hose connected to said fuel tank interface means and the fuel tank so as to provide fluid communication between said fuel tank interface means and the fuel tank.

9. A system as recited in claim 8, wherein said fuel tank interface means comprises:

a threaded cylinder neck fluidly joined to the boat fuel tank;

a vented nozzle receiving means for tightly receiving a fuel nozzle used in filling tanks with fuel; and a fuel feed line fluidly joining said threaded cylinder neck and the fuel tank for directing fuel from said threaded cylinder neck into the fuel tank.

10. A system as recited in claim 6, wherein said fuel tank interface means comprises:

a threaded cylinder neck fluidly joined to the fuel tank;

a vented nozzle receiving means for tightly receiving a fuel nozzle used in filling tanks with fuel; and a fuel feed line fluidly joining said threaded cylinder neck and the fuel tank for directing fuel from said threaded cylinder neck into the fuel tank.

11. A system as recited in claim 10, wherein said pressure equalizing means comprises a one-direction valve securely installed in said fuel cap means for only allowing the flow of air and vapor from said system out said fuel cap means.

12. A system as recited in claim 11, further comprising a fuel tank in fluid communication with said tank vent means and said fuel tank interface means.

* * * * *